US006736621B2

(12) United States Patent
Barito et al.

(10) Patent No.: US 6,736,621 B2
(45) Date of Patent: May 18, 2004

(54) SCROLL COMPRESSOR WITH ADJUSTABLE CAPACITY

(75) Inventors: Thomas R. Barito, Arkadelphia, AR (US); Zili Sun, Arkadelphia, AR (US); William B. Kroll, Arkadelphia, AR (US); Joseph F. Loprete, Bristol, TN (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/264,753

(22) Filed: Oct. 4, 2002

(65) Prior Publication Data

US 2004/0067146 A1 Apr. 8, 2004

(51) Int. Cl.[7] ..... F04C 18/04; F04C 29/10

(52) U.S. Cl. ..... 418/55.2; 418/28; 418/55.4

(58) Field of Search ..... 418/22, 28, 55.2, 418/55.4

(56) References Cited

U.S. PATENT DOCUMENTS 3,994,635 A * 11/1976 McCullough ..... 418/55.2

FOREIGN PATENT DOCUMENTS

| | | | | |
|---|---|---|---|---|
| JP | 53-141913 | * | 12/1978 | ..... 418/28 |
| JP | 57-68580 | * | 4/1982 | ..... 418/55.2 |
| JP | 61-123789 | * | 6/1986 | ..... 418/28 |
| JP | 63-223379 | * | 9/1988 | ..... 418/55.2 |

* cited by examiner

*Primary Examiner*—John J. Vrablik
(74) *Attorney, Agent, or Firm*—Carlson, Gaskey & Olds

(57) ABSTRACT

A scroll compressor includes an adjustable actuator mount that changes the relative position of a non-orbiting scroll and an orbiting scroll to change the compressor capacity. In one embodiment, the scroll wrap and base of each scroll are manufactured as two separate components with a wrap modulator between the scroll wrap and the base of each scroll. As the mount moves the scrolls apart and together, the wrap modulators extend and retract the scroll wraps relative to their respective bases to maintain fluid-tight compression chambers.

14 Claims, 3 Drawing Sheets

SCROLL COMPRESSOR WITH ADJUSTABLE CAPACITY

BACKGROUND OF THE INVENTION

The invention relates to scroll compressors, and more particularly to controlling compressor capacity in a scroll compressor.

Scroll compressors are widely used in refrigerant compression applications. A scroll compressor typically includes two interfitting scroll members. Each scroll member has a base with a generally spiral scroll wrap extending from the base. The wraps interfit to define a plurality of compression chambers. One scroll member is a non-orbiting scroll member, which remains at a stationary position, while the other scroll member is an orbiting scroll member, which orbits relative to the non-orbiting scroll member. The relative orbiting movement causes the wrap in the orbiting scroll member to move relative to the wrap in the non-orbiting scroll member, changing the volume of the compression chambers. This changing volume compresses refrigerant trapped in the compression chambers.

Different applications often call for scroll compressors having different chamber capacities. The chamber capacities can be changed by modifying the dimensions (e.g., the height) of the scroll wraps during compressor manufacture. Each scroll compressor will still have a fixed capacity, however, because the scroll wrap dimensions cannot change once the scroll wrap is actually in the compressor. Changing the capacity of a given compressor would require exchanging a component having one scroll wrap dimension for a corresponding component having a different scroll wrap dimension. While several methods of capacity control using various complex valving schemes have been developed, it would be desirable to develop additional methods.

There is a desire for a scroll compressor structure having an adjustable capacity.

SUMMARY OF THE INVENTION

Accordingly, the present invention is directed to a scroll compressor having an adjustable compressor capacity. One or both scroll wraps in the compressor are coupled to an actuator mount that changes the distance between the bases of the scroll members. The wraps also, preferably, adjust to compensate for this movement. This adjustment can occur via springs, gas devices, hydraulic devices, or other similar adjustment structures. As a result, the compressor capacity can be adjusted at any time and does not require replacement or exchange of compressor components.

DETAILED DESCRIPTION OF THE EMBODIMENTS

Figure 1:
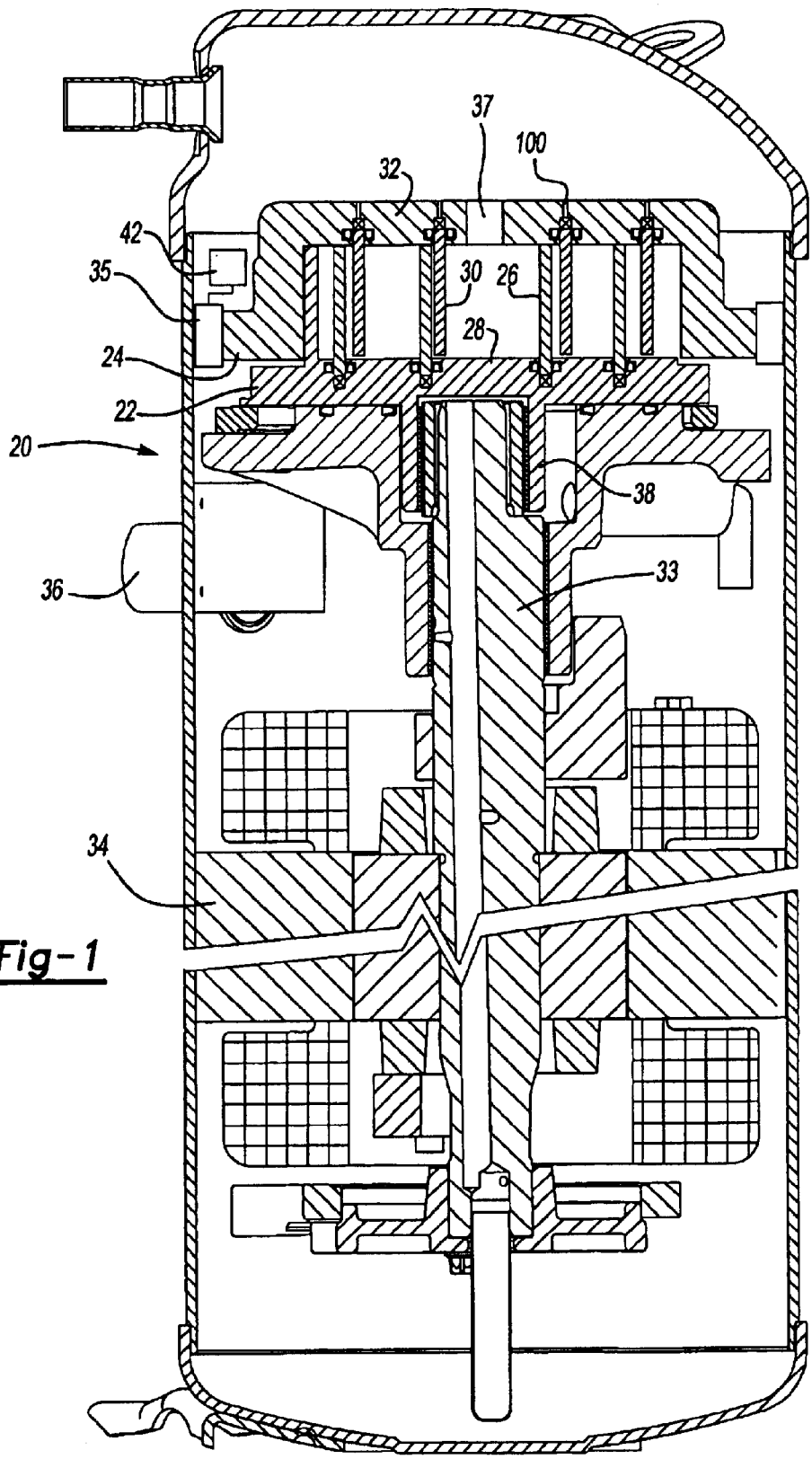
FIG. 1 is a cross-sectional view of a scroll compressor according to one embodiment of the invention.

FIG. 1 illustrates a scroll compressor 20 according to one embodiment of the invention. The scroll compressor 20 includes an orbiting scroll 22 that interfits with a non-orbiting scroll 24 to define compression chambers. The orbiting scroll 22 is constructed with a generally spiral scroll wrap 26 mounted on a base 28. In one embodiment, the non-orbiting scroll 24 is also constructed with a generally spiral scroll wrap 30 mounted on a base 32. The orbiting scroll 22 is driven by an input shaft 33 driven by a motor 34. The non-orbiting scroll 24 is attached to an actuator mount 35 that can guide and drive the non-orbiting scroll 24 for movement up and down relative to the orbiting scroll 22. Note that the mount 35 can be coupled to either the orbiting scroll 22, the non-orbiting scroll 24, or both scrolls to move them closer together and farther apart. The mount 35 can be any known device that can control scroll position within the compressor 20. Preferably, mount 35 includes both bearing supports and a drive motor. The compressor 20 also includes an inlet 36 that pulls air into the compressor 20 to create suction pressure in an area below the scrolls 22, 24. The non-orbiting scroll 24 also has a discharge vent 37 to create discharge pressure in an area above the non-orbiting scroll 24.

Figure 2:
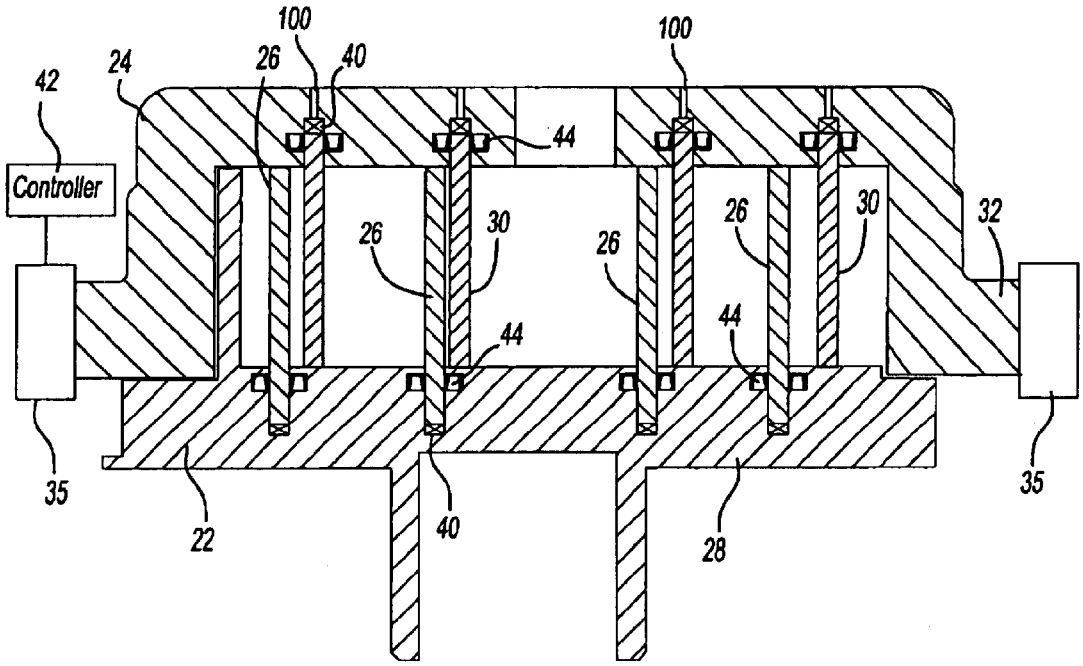
FIG. 2 is a cross-sectional view of one portion of the scroll compressor shown in FIG. 1 in a first position.
Figure 3:
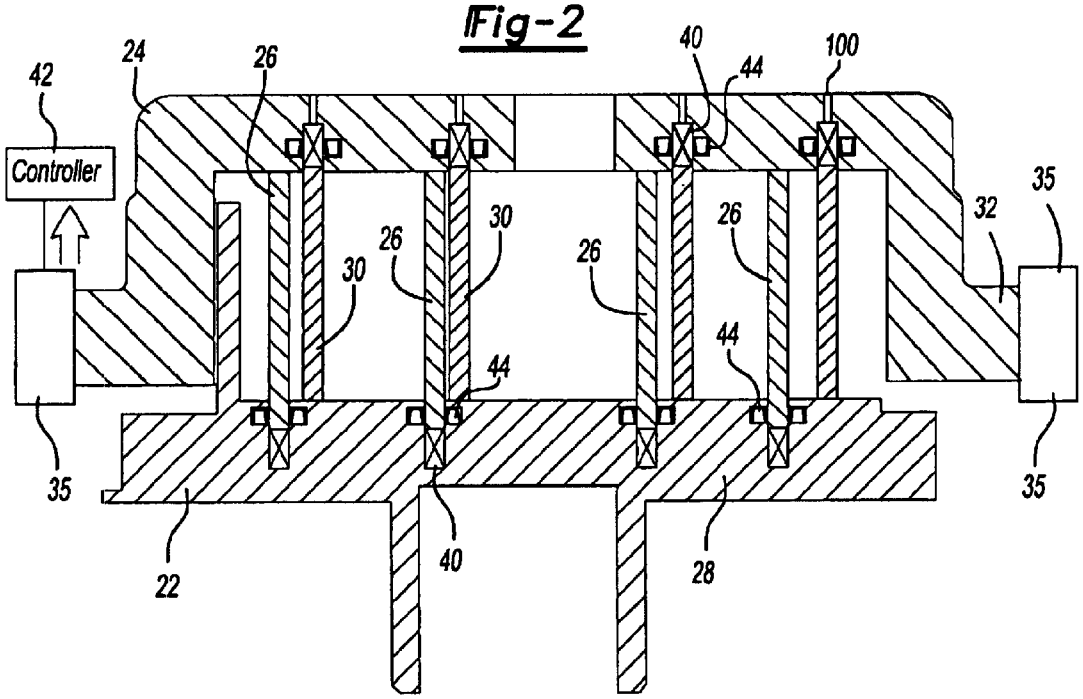
FIG. 3 is a cross-sectional view of one portion of the scroll compressor shown in FIG. 1 in a second position.

FIGS. 2 and 3 are cross-sectional views of the orbiting scroll 22 and non-orbiting scroll 24 according to one embodiment of the invention. FIG. 2 illustrates the scrolls 22, 24 in a retracted, lower capacity position, while FIG. 3 illustrates the scrolls 22, 24 in an extended, higher capacity position. As shown in the Figures, the scroll wraps 26, 30 in both scrolls 22, 24 are installed as components separate from their respective bases 28, 32.

In one embodiment, a wrap modulator 40 is coupled to each scroll wrap 26, 30. The wrap modulator 40 may be any structure or device that allows the scroll wraps 26, 30 to move relative to their corresponding bases 28, 32. Springs, gas pressure devices, and hydraulic pressure devices are all possible structures for the wrap modulator 40. Also, a discharge refrigerant tap 100 may supply the bias force.

To modulate compressor capacity during operation, the controller 42 controls the mount 35 to raise and lower the non-orbiting scroll 22 on command. In one embodiment, the controller 42 is any device compatible with the mount 35 and having a user interface. For example, if the mount 35 has a hydraulic drive, the controller 42 may be any known hydraulic control. Typically an electronic control is also used to determined when the movement should occur.

When the mount 35 raises the non-orbiting scroll 24 or otherwise separates the non-orbiting scroll 24 and the orbiting scroll 22, the wrap modulator 40 in the orbiting scroll 22 extends the scroll wrap 26 in the orbiting scroll 22 relative to its base 28 so that the scroll wrap 26 of the orbiting scroll 22 continues to touch the base 32 of the non-orbiting scroll 24. Similarly, the wrap modulator 40 in the non-orbiting scroll 24 extends so that the scroll wrap 30 of the non-orbiting scroll 24 continues to touch the base 28 of the orbiting scroll 22. When the mount 35 lowers the non-orbiting scroll 24 or otherwise brings the two scrolls 22, 24 closer together, the wrap modulator 40 in each scroll 22, 24 retracts, allowing the wraps 26, 30 to retract back into their respective bases 28, 32.

The mount 35 may be infinitely adjustable or incrementally adjustable, depending on the desired application. Further, if desired, the mount 35 and controller 42 may be configured to allow toggling between infinite and incremental adjustments in the same scroll compressor 20 structure.

Because the scroll wrap 26, 30 and the base 28, 32 are two separate components to allow adjustment of the scroll wrap's 26, 30 position relative to the base, a seal 44 may be applied at the juncture between the scroll wrap 26, 30 and the base 28, 32 to prevent compressor fluid from reaching the wrap modulator 40. The seal 44 may be any known fluid-tight structure, such as a U-cup seal or a flip seal.

Figure 4:
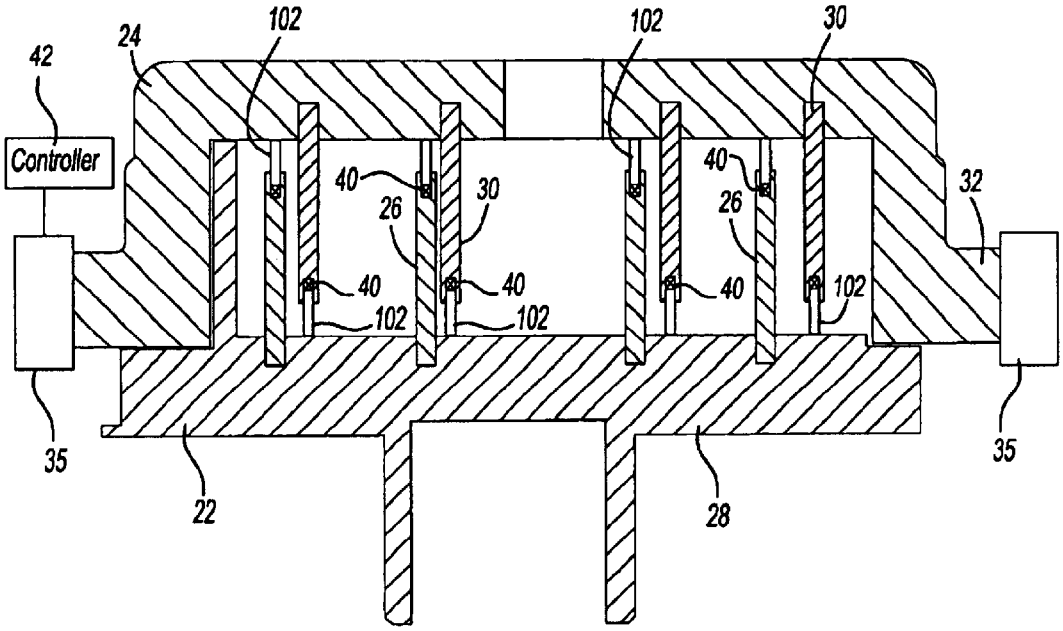
FIG. 4 is a cross-sectional view of one portion of the scroll compressor according to another embodiment of the invention.

FIG. 4 illustrates another embodiment of the invention. In this embodiment, the wrap modulator 40 is coupled to a known tip seal 102. The wrap modulator 40 allows the tip seal 102 to extend and retract relative to the scroll wrap 26, 30.

As noted above, the compressor capacity may be adjusted at any time, including during compressor operation, by changing the relative position of the scrolls 22, 24 and allowing the wraps 26, 30 to extend and retract relative to the bases 28, 32 to maintain contact between the wraps 26, 30 and the base 32, 28 opposite the wraps. The wrap modulators 40 and seals 44 ensure that the compression chambers remain fluid-tight even though they have adjustable capacities. Because the relative scroll position, and therefore the compressor capacity, is adjusted via an external mount 35 and an external controller 42, a user can adjust the compressor capacity without having to disassemble the compressor 20 or exchange any components.

A worker in this art would recognize when different capacities would be desired

Incorporating moveable scrolls and scroll wraps in the scroll compressor 20 allows the compressor capacity to be adjusted easily, even during compressor operation. Further, the inventive structure eliminates the need to manufacture scrolls having different scroll wrap dimensions to generate different capacities; instead, the same scroll compressor structure can have different capacities by simply adjusting the position of one or both scrolls.

Although a preferred embodiment of this invention has been disclosed, a worker of ordinary skill in the art would recognize that certain modifications would come within the scope of this invention. For that reason, the following claims should be studied to determine the true scope and content of this invention.

What is claimed is:

1. A scroll compressor, comprising:

a first scroll including a first base and a first scroll wrap extending from the first base;

a second scroll including a second base and a second scroll wrap extending from the second base, the first and second scroll wraps interfitting to define a plurality of compression chambers; and a controller coupled to at least one of the first scroll and the second scroll; and an actuator mount coupling the controller to at least one of the first scroll and the second scroll, wherein the actuator mount is responsive to the controller to change a relative distance between the first base and the second base;

a first wrap modulator coupled to the first scroll wrap;

a second wrap modulator coupled to the second scroll wrap, wherein the first and second wrap modulators allow the first scroll wrap and the second scroll wrap to extend out of and retract into the first base and the second base, respectively; and a first seal at a juncture between the first scroll wrap and the first base and a second seal at the juncture between the second scroll wrap and the second base.

2. The scroll compressor of claim 1, wherein at least one of said first wrap modulator and said second wrap modulator is selected from the group consisting of a spring, a gas tap, a gas device, and a hydraulic device.

3. The scroll compressor of claim 1, wherein the first scroll is a non-orbiting scroll, and wherein the actuator mount is coupled to the non-orbiting scroll.

4. The scroll compressor of claim 1, wherein the actuator mount is infinitely adjustable.

5. The scroll compressor of claim 1, wherein the actuator mount is incrementally adjustable.

6. The scroll compressor of claim 1, wherein the controller can switch the actuator mount between an infinite adjustment setting and an incremental adjustment setting.

7. A scroll compressor, comprising:

a first scroll including a first base and a first scroll wrap extending from the first base;

a second scroll including a second base and a second scroll wrap extending from the second base, the first and second scroll wraps interfitting to define a plurality of compression chambers; and a controller coupled to at least one of the first scroll and the second scroll;

an actuator mount coupling the controller to at least one of the first scroll and the second scroll, wherein the actuator mount is responsive to the controller to change a relative distance between the first base and the second base;

a wrap modulator coupled to at least one of the first scroll wrap and the second scroll wrap, wherein the wrap modulator allows at least one of the first scroll wrap and the second scroll wrap to extend out of and retract into the first base and the second base, respectively; and at least one seal at a juncture between at least one of the first scroll wrap and the first base and the juncture between the second scroll wrap and the second base.

8. The scroll compressor of claim 7, wherein the wrap modulator is one selected from the group consisting of a spring, a gas tap, a gas device, and a hydraulic device.

9. The scroll compressor of claim 7, wherein said at least one seal is a tip seal disposed on at least one of the first scroll wrap and the second scroll wrap, and wherein the wrap modulator is coupled to the tip seal to allow the tip seal to extend out of and retract into at least one of the first scroll wrap and the second scroll wrap.

10. The scroll compressor of claim 7, wherein the actuator mount is infinitely adjustable.

11. The scroll compressor of claim 7, wherein the actuator mount is incrementally adjustable.

12. The scroll compressor of claim 7, wherein the controller can switch the actuator mount between an infinite adjustment setting and an incremental adjustment setting.

13. A scroll for a scroll compressor, comprising:

a scroll having a base and a first scroll wrap extending from the base, wherein the scroll wrap is designed to interfit with a second scroll wrap to define a plurality of compression chambers;

a wrap modulator coupled to the first scroll wrap, wherein the wrap modulator allows the scroll wrap to move relative to the base; and an actuator mount connected to the scroll wherein the actuator mount is responsive to a controller to change a relative distance between the first base and the second base; aid a seal at a juncture between the first scroll wrap and the base.

14. The scroll of claim 13, wherein the wrap modulator is one selected from the group consisting of a spring, a gas tap, a gas device, and a hydraulic device.

* * * * *

UNITED STATES PATENT AND TRADEMARK OFFICE

CERTIFICATE OF CORRECTION

PATENT NO. : 6,736,621 B2
DATED : May 18, 2004
INVENTOR(S) : Barito et al.

It is certified that error appears in the above-identified patent and that said Letters Patent is hereby corrected as shown below:

Column 4,
Line 57, “aid” should be -- and --.

Signed and Sealed this

Thirteenth Day of July, 2004

JON W. DUDAS
*Acting Director of the United States Patent and Trademark Office*